United States Patent [19]

Roberts

[11] 4,188,848

[45] Feb. 19, 1980

[54] DIGITAL TONE AND CHORD GENERATORS

[75] Inventor: Patrick S. Roberts, Rolling Meadows, Ill.

[73] Assignee: Thomas International Corporation, Chicago, Ill.

[21] Appl. No.: 849,129

[22] Filed: Nov. 7, 1977

Related U.S. Application Data

[63] Continuation of Ser. No. 555,791, Mar. 6, 1975, abandoned.

[51] Int. Cl.[2] ..... G10H 1/00; G10H 5/00

[52] U.S. Cl. ..... 84/1.01; 84/1.03; 84/DIG. 22

[58] Field of Search ..... 84/1.01, 1.03, 1.17, 84/1.24, DIG. 22, DIG. 12; 328/63, 140

[56] References Cited

U.S. PATENT DOCUMENTS

| | | | |
|---|---|---|---|
| 3,544,693 | 12/1970 | Tripp | 84/1.01 |
| 3,605,026 | 9/1971 | Bowden | 328/63 |
| 3,610,801 | 10/1971 | Fredrin | 84/1.03 |
| 3,696,201 | 10/1972 | Arsem et al. | 84/1.01 |
| 3,878,750 | 4/1975 | Kapps | 84/1.01 |
| 3,889,568 | 6/1975 | Amata | 84/1.01 |
| 3,929,051 | 12/1975 | Moore | 84/1.17 |
| 4,041,825 | 8/1977 | Pascetta | 84/1.01 |

*Primary Examiner*—Vit W. Miska

*Attorney, Agent, or Firm*—Wegner, Stellman, McCord, Wiles & Wood

[57] ABSTRACT

An electronic organ includes a read-only memory which stores eight bit binary words each having a digital value proportional to the frequency of a different note. When a chord keyswitch is actuated, a corresponding chord selector controlled by a multiplexer circuit causes the randomly addressable memory to sequentially generate binary words corresponding to the frequencies of the notes forming the selected chord. Each binary word is stored in a latch associated with a different universal tone generator capable of generating any tone as controlled by the stored binary word. Each universal tone generator includes a comparator which recognizes a match between the associated latch and a counter which receives clock pulses from a single fixed frequency oscillator. The comparator resets the counter and generates an output pulse which is divided to form an audible tone signal.

13 Claims, 3 Drawing Figures

DIGITAL TONE AND CHORD GENERATORS

RELATED APPLICATIONS

This application is a continuation of application Ser. No. 555,791 filed Mar. 6, 1975, now abandoned.

BACKGROUND OF THE INVENTION

This invention relates to an entirely digital tone and chord generator for an electronic musical instrument.

Prior electronic organs have used four bit binary words to represent the twelve notes in an octave. A binary-to-digital decoder enables a single note line in response to the presence of a particular binary word. The single note line then enables a gate in order to pass a cyclical tone signal from a separate tone generator to the voicing circuits. An example of such a circuit is shown in Tripp U.S. Pat. No. 3,544,693.

Tone generators have used both digital and analog circuitry to generate the plurality of cyclical tone signals which are gated under control of the digital note selector. A plurality of separate oscillators may be used for each note, or a single oscillator may be coupled to dividers interconnected to produce separate pulse trains representing the cyclical tone signals. In Freeman U.S. Pat. No. 3,236,931, for example, a voltage controlled oscillator generates a root note which is coupled to variable counters to produce a plurality of chordally related audible signals. Manually controllable keyboard bars actuate switches which alter the division ratios of some of the counters in order to produce submultiples of the root frequency which differ from each other by less than one octave. While use of variable ratio counters simplifies the tone generating circuit, the root note still must be generated by a controllable oscillator.

Since note selection has been considered separate from the audible tone generating circuits, separate tone selecting circuitry and tone generating circuitry has evolved in prior electronic organs. While tone selection has been digital in nature, and tone generation has been digital in nature, separate circuits have been required for these functions.

SUMMARY OF THE INVENTION

In accordance with the present invention, an electronic musical instrument includes universal tone and chord generating circuits which combine the functions of note selection and tone generation. A single fixed frequency oscillator provides pulses which are digitally processed to provide forty-eight possible chords, while eliminating the need for a large number of tone generators. A note selector circuit generates binary words having a digital value inversely proportional to the actual frequency to be reproduced. A universal note generator capable of digitally generating any cyclical tone signal within an octave generates a pulse train corresponding to the digital value of a generated binary word. The tone generator is an integral part of the tone selector.

The novel tone selector and tone generator can be incorporated into a universal chord generator which can provide a large number of chords by means of very little circuitry. Because the entire system is digital, it can be embodied in integrated circuit form. Reduction in circuitry is also accomplished by using a divide by three system to generate the root tone from the fifth tone. Additionally multiplexing techniques are used to control generation of tones in order to reduce circuitry.

One object of this invention is the provision of a universal tone generator using entirely digital circuitry for generating any one of a large number of cyclical tone signals, as selected by binary words representing the frequencies to be reproduced.

Another object of this invention is the provision of an electronic musical instrument having a universal chord generating circuit which is entirely digital in operation. One feature of the chord generating circuit is the use of a randomly addressable memory for rapid selection of the notes forming a selected chord.

Further objects and features of the invention will be apparent from the following description and from the drawings. While an illustrative embodiment of the invention is shown in the drawings and will be described in detail herein, the invention is susceptible of embodiment in many different forms and it should be understood that the present disclosure is to be considered as an exemplification of the principles of the invention and is not intended to limit the invention to the embodiment illustrated.

DESCRIPTION OF THE PREFERRED EMBODIMENT

Figure 1:
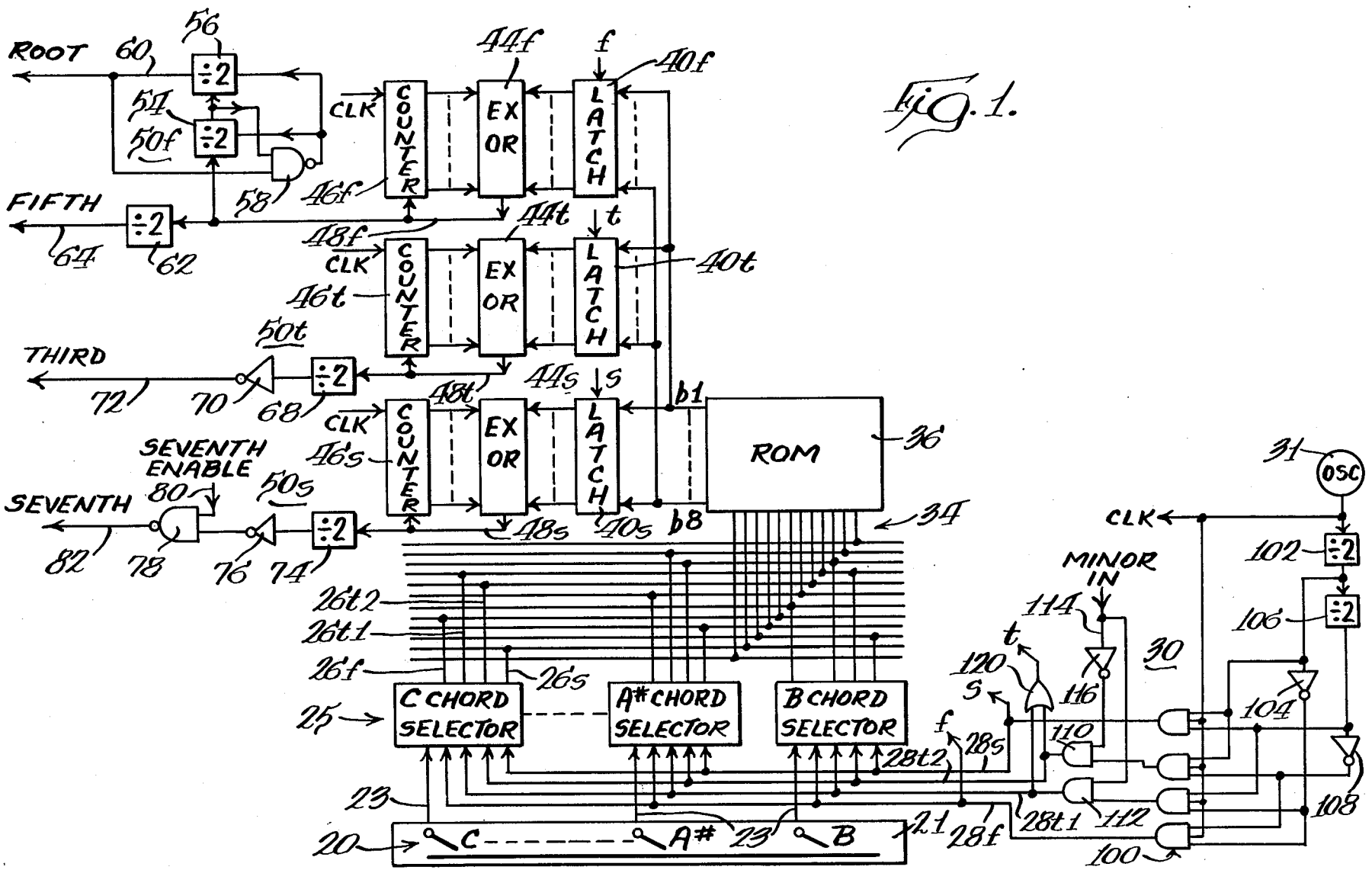
FIG. 1 is a partly block and partly schematic diagram of universal tone and chord generators as incorporated in an electronic musical instrument.

In FIG. 1, a chord generating circuit for the accompaniment portion of an electronic organ is illustrated. Conventional circuitry may be provided for the solo or upper manual of the electronic organ, and for the remaining portion of the lower manual, as well as for the voicing and other portions of the electronic organ. The accompaniment manual includes a plurality of keyswitch contacts 20 which are connected by a conventional priority input circuit 21 to separate chord selection lines 23, one of which is enabled when a chord corresponding to a selected keyswitch 20 is desired. For example, if the B key of the lower manual is depressed, an enabling signal will be generated on the chord select line 23 leading from the B keyswitch 20. The priority input circuitry, 21, allows only the lowest chord select line, 23, to become enabled if multiple keys are depressed so that only one of the twelve chord select lines 23 can be enabled at one time The chord select lines 23 are individually coupled to corresponding chord selectors 25, each of which generates the interval notes corresponding to the selected chord. Each chord selector 25 has four output lines **26*f*, 26*t*1, 26*t*2 and 26*s*, corresponding to the fifth, minor third, major third, and seventh intervals of the selected chord. Only one outputline 26 is enabled at a time, depending upon which one of four input lines 28*f*, 28*t*1, 28*t*2 and 28*s* has been sequentially enabled by a multiplex circuit 30. The multiplexer circuit consists of the master clock 31, a two bit binary counter 102 and 106 and a two bit to four line decoder 100**. The decoder continually cycles to sequentially enable its output lines.

Lines 28*t*1 and 28*t*2 have been gated by the Minor In line so that either line 28*t*1 or line 28*t*2 will be enabled for each two bit count of the counter. Thus three of the four lines 28 will be sequentially enabled for each complete cycle of the multiplexer circuit. Lines 26 are sequentially enabled in response to the enabling of lines 28 and a chord select line. Either line 26*t*1 or line 26*t*2 will be enabled for each cycle of multiplexer circuit 30, depending on the information on the Minor In line. Oscillator 31 produces pulses at a suitably high frequency which in the preferred embodiment is 66.44 KHz. By way of example, when the C keyswitch 20 is depressed and the multiplexer circuit 30 enables input line 28*f*, then the C chord selector 25 generates an output signal on line 26*f*. While only three chord selectors 25 have been illustrated, it will be appreciated that twelve chord selectors are provided for the twelve notes of the octave for which the single-finger chord selection mode is available.

The output lines 26 are each connected to various ones of twelve input lines 34 of an encoder for producing twelve encoded signals representing the twelve different tones. Herein, the encoder is in the form of a non-erasable storage device or read-only memory (ROM) 36. Each address input line 34 corresponds to a different note which can be selected from the various interval notes which form each possible chord. For example, output line 26*f* from the C chord selector 25 is connected to the G note address input line 34, because a G note represents the fifth interval for a C root note. Other output lines 26 are connected to the same G note input line 34, since the G note is present in the formation of other chords.

ROM 36 comprises a twelve-by-eight bit, random access memory which stores permanently an eight bit binary word, having bit positions b1 through b8, for each address input line. Each address input line 34, which can be addressed randomly, that is, in any order, when enabled generates on output lines b1–b8 a single eight bit binary word having a digital value inversely proportional to the frequency of the selected note. Unlike prior electronic organs in which four bit binary words have digital values representing the note position within an octave, the eight bit word utilized herein is much longer in length, and represents the actual frequency to be generated. Because the word has eight bit positions, up to 255 different combinations are available. Also the memory can be accessed randomly, so no delay is introduced of the type present in circuits which sequentially cycle through various selectable note generators.

Assuming a particular keyswitch 20 is depressed so that a single chord selector 25 is enabled, the encoded binary output word b1–b8 changes at a rate of one-quarter of the frequency of the clock OSC 31, in accordance with the sequential enabling of the input lines 28. Thus, the binary output word changes as the multiplex circuit 30 enables the fifth output f, the seventh output s, or either one of the third outputs t (either the minor third t1 or the major third t2 will be enabled, but not both). These binary words are stored in separate universal note generators, one for each interval note which can be generated. Each note generator or channel includes a storage memory or latch 40. A latch 40*f* is provided for storing the fifth interval binary word, a latch 40*t* for storing the third interval binary word, and a latch 40*s* for storing the seventh interval binary word. As will appear, the root frequency is approximated by $\frac{2}{3}$ times the fifth frequency, eliminating the necessity for a separate universal note generator for the root note.

Each memory latch 40 has an input from the multiplex circuit 30 so as to gate open the latch during the proper time interval. During the time that input line 28*f* is enabled to cause one of the chord selectors 25 to generate an output 26*f*, the ROM 36 generates a binary word b1–b8 which represents the frequency of the fifth interval note. At this time, an output f from the multiplex circuit 30 enables latch 40*f*, causing the fifth interval binary word to be stored therein. During the remaining three counts or states of the multiplex circuit, latch 40*f* cannot accept a new input.

Each tone generator or channel of the pulse generating means is similar, and will be described using the same reference numerals, followed by an f, t, or s depending on whether it is associated with the fifth interval, the third interval, or the seventh interval, respectively. Each latch 40 has its outputs coupled to an exclusive or (EX OR) circuit 44 for comparison with the binary count of a counter 46. The clock pulses CLK are coupled to each counter 46, and cause the counter to step until the binary count therein matches the binary word stored in the associated latch 40. Upon detecting a match, the EX OR circuit 44 generates on a line 48 an output pulse which resets the counter 46 to zero, and is also coupled to a divider circuit 50. The divider output pulses form the cyclical tone signals which are coupled to voicing circuitry to form the audible interval notes produced by the organ.

Divider circuit 50*f* is separated into two branches. A root channel consists of a pair of cascaded divide-by-two dividers 54,56 and a NAND gate 58 which resets the dividers 54,56 at the count of three, so that the root channel divides the output pulses on line 48*f* by three. This produces on a Root line 60 a cyclical tone signal which represents the root note. The output pulses on line 48*f* are also coupled to a fifth channel consisting of a divide-by-two divider 62 having a Fifth output line 64. Thus, the root note is approximated as $\frac{2}{3}$ times the fifth note frequency.

Divider circuit 50*t* consists of a divide-by-two divider 68 in cascade with a NOT gate 70 in order to produce on a Third line 72 the third interval tone signal. The divider circuit 50*s* similarly consists of a divide-by-two divider 74 in cascade with a NOT gate 76. The output is coupled to a NAND gate 78 which also has as an input a seventh enable line 80. Line 80 may be controlled by conventional electronic organ circuitry and, whenever a seventh interval is to be utilized, an enabling bit on line 80 allows the divided output pulses to pass to a Seventh line 82. The four frequencies on lines 60, 72, 74 and 82, which represent the root note, third note, fifth note and seventh note, respectively of the selected chord, can be used to compose any desired chord of a possible forty-eight. Thus, a major chord, a minor chord, a seventh chord, and a minor seventh chord can be produced by appropriate gating of the output lines 60, 64, 72 and 82. The gating may be accomplished by conventional organ circuitry which selects the type of chord which is to be reproduced.

Thus each tone generator consisting of components 40, 44, 46, 50, generates any one of twelve different frequency tones, depending upon the binary word which is coupled thereto. The inputs to the three latches 40 could have been provided from three ROM's 36, rather than from a single ROM operating in a multiplexed fashion as shown. Due to the multiplexing system, the chord generating circuit eliminates the need for a large number of tone generators. Similarly, separate channels could be provided for the root tone and the fifth note, if desired. In addition to achieving a large number of chords by means of very little circuitry, the above described system is readily adaptable to integrated circuit form.

The details of the universal tone and chord generators will now be described. Multiplex circuit 30, see FIG. 1, provides three sequential outputs 28*f*, 28*t*1 or 28*t*2, and 28*s*, in order to cause the single ROM 36 to sequentially generate three binary words which represent the frequencies of the fifth, third, and seventh interval notes, respectively. The 66.44 KHz clock OSC 31 produces CLK pulses which are coupled to four AND gates 100. The CLK pulses are also coupled to a divide-by-two divider 102 which produces an output coupled to the first two of the AND gates 100. The output of divider 102 is inverted by a NOT gate 104 and is coupled to the remaining two of the AND gates 100. The output of divider 102 is also coupled to a divide-by-two divider 106 having outputs coupled to the first and third AND gates 100. The output of divider 106 is also inverted by NOT gate 108 for coupling to the second and fourth gates 100. The illustrated circuit forms a one-in-four decoder in order to sequentially enable the four output lines from the AND gates 100.

The second and third AND gates 100 are coupled to a pair of AND gates 110, 112 which also have inputs from a Minor In line 114, which is inverted by NOT gate 116 in the case of AND gate 110. The Minor In line 114 has a signal thereon, generated by a conventional organ chord selecting circuit, whenever a minor chord is to be reproduced. Thus, the AND gates 110, 112 cause output lines 28*t*2 to be enabled when a major chord is to be played, and cause output line 28*t*1 to be enabled when a minor chord is to be played. Both AND gates 110, 112 have inputs to an OR gate 120 which generates a t output for coupling to latch 40*t*. Thus, the latch 40*t* is opened during the two intervals when a minor third interval binary word, or a major third interval binary word can be generated.

Figure 2:
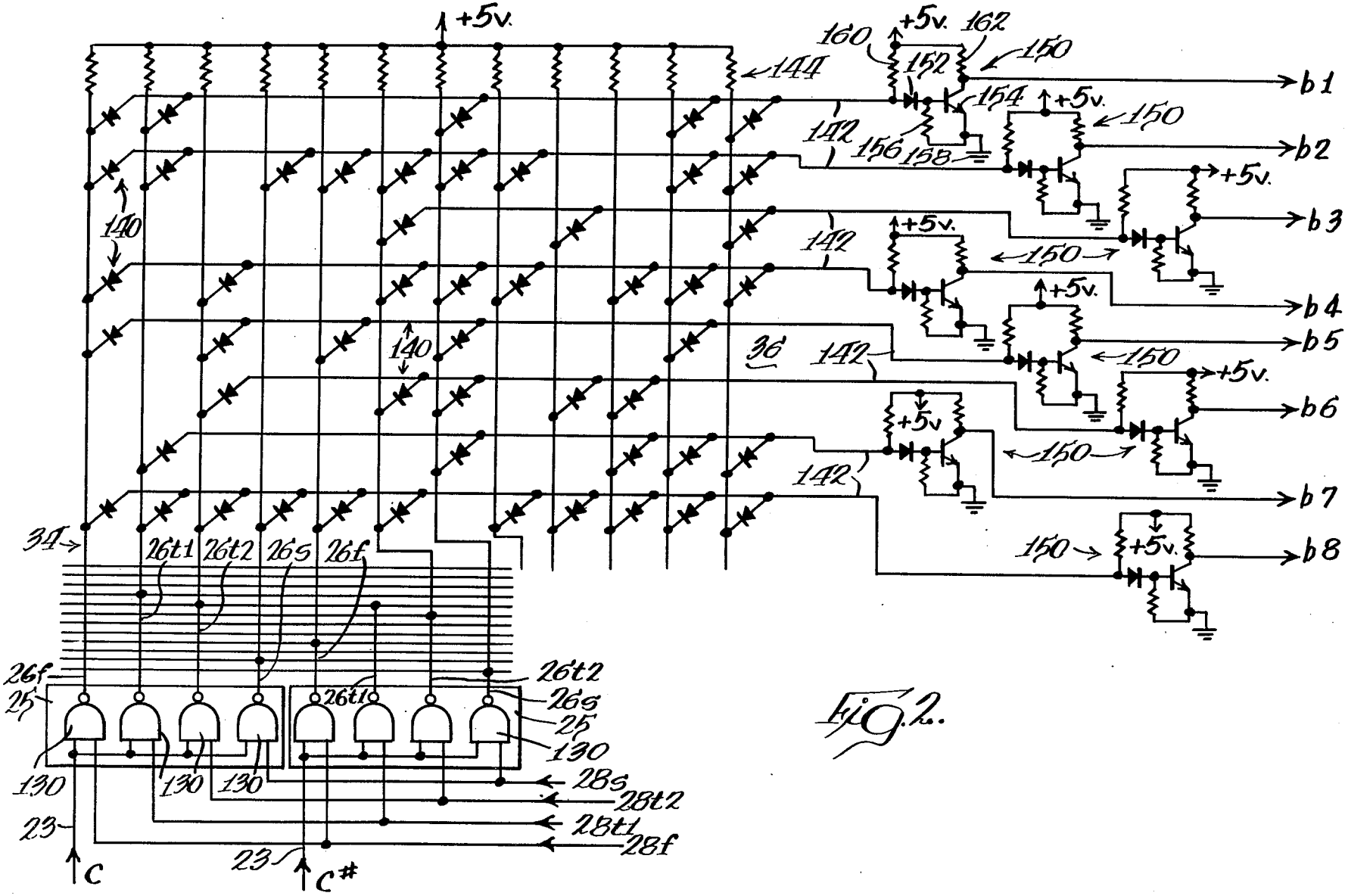
FIG. 2 is a schematic diagram showing in detail the chord selector circuitry and the read-only memory (ROM) shown in block form in FIG. 1.

Turning to FIG. 2, the chord selectors 25 and ROM 36 circuits are shown in detail. For clarity, only two of the twelve chord selectors 25 are illustrated. The entire ROM 36 is illustrated, but the address input lines 34 are shown connected only to the output lines 26 associated with the two illustrated chord selectors 25 for the C chord and the C# chord. Each chord selector 25 consists of four NAND gates 130. One input of each of the four NAND gates 130 is connected to the associated chord select line 23. The other inputs are coupled to the output lines 28*f*, 28*t*1, 28*t*2 and 28*s* of the multiplex circuit 30. When no note is selected, all NAND gate outputs are logic 1 bits, and all buffer outputs b1–b8 from the ROM 36 are low. Whenever an individual NAND gate 130 receives two logic 1 bit inputs, its output goes low on the associated output line 26.

The G note input line 34, that is, the line 34 which is connected with line 26F of the C chord selector 25 which forms the fifth note in a C chord is also coupled to the other chord selectors 25 which require the G note in forming its chord. Thus, connection is also made with the D# chord selector output on line 26*t*2 (to form the third in a major D# chord), the E chord selector output on line 26*t*1 (to form the third in a minor E chord), and the A chord selector output on line 26*s* (to form the minor seventh in an A chord).

ROM 36 comprises a diode twelve-by-eight bit read-only memory. Individual unidirectional conduction devices, as diodes 140, interconnect each of the twelve vertical input lines 34 with selected ones of the eight horizontal output lines 142. The vertical and horizontal lines form a matrix of addressable storage locations, each of which stores a single eight bit word. Each vertical input line 34 is coupled through a 1.8 kilohm resistor 144 to a regulated DC supply at +5 volts. Each horizontal line 142 is coupled to a transistor buffer 150 which includes a diode 152 connected to the base of a transistor 154. The base is also coupled through a resistor 156 to a source of reference potential or ground 158. The emitter of transistor 154 is directly coupled to ground 158. The anode of diode 152 is coupled through a resistor 160 and a resistor 162 to the collector of the transistor, and to an output line b. The function of resistors 160 and 162 are connected to a source of regulated DC supply at 5 volts.

When an output line 26 goes to a 0 bit, representing that the associated NAND gate 130 has received enabling 1 bit inputs, the address input line 34 directly coupled thereto goes to a 0 bit. The diodes 140 coupled to that line draw current and bias off the transistors 154 associated with those diodes, producing a 1 bit output on the associated lines b. The output line b1 represents the least significant bit, and the output line b8 represents the most significant bit of the eight bit binary words. The diodes 140 are connected so as to generate twelve binary words, each of eight bits length, with the digital value of each binary word being inversely proportional to the frequency of the audible tone signal to be reproduced. For example, when the G line 23 and the line 28*f* both have 1 bits, output line 26*f* from the G chord selector 25 will have a 0 bit. This causes the ROM 36 and associated buffers 150 to generate the eight bit binary word 10011011, which has a digital value of 155. This digital value is an integral multiple of a tone frequency of Hz, which represents the fifth interval note in a G chord, namely, the note D. This digital value represents the number of pulses which are to be generated, for a given increment of time in order to produce an audible note D. For the illustrated system, the ROM 36 is wired in a matrix array to produce the following binary words indicated in Table 1, for the twelve notes which can be addressed by a signal on the address input lines 34.

TABLE 1

| NOTE | b8 | b7 | b6 | b5 | b4 | b3 | b2 | b1 | Dig. Val. | Interval Freq. |
|---|---|---|---|---|---|---|---|---|---|---|
| C | 1 | 1 | 1 | 1 | 1 | 1 | 1 | 0 | 254 | 261.6 |
| C# | 1 | 1 | 1 | 1 | 0 | 0 | 0 | 0 | 240 | 276.8 |
| D | 1 | 1 | 1 | 0 | 0 | 0 | 1 | 0 | 226 | 294.0 |
| D# | 1 | 1 | 0 | 1 | 0 | 1 | 1 | 0 | 214 | 310.5 |
| E | 1 | 1 | 0 | 0 | 1 | 0 | 1 | 0 | 202 | 328.9 |
| F | 1 | 0 | 1 | 1 | 1 | 1 | 1 | 0 | 190 | 349.7 |
| F# | 1 | 0 | 1 | 1 | 0 | 1 | 0 | 0 | 180 | 369.1 |
| G | 1 | 0 | 1 | 0 | 1 | 0 | 0 | 1 | 169 | 393.1 |
| G# | 1 | 0 | 1 | 0 | 0 | 0 | 0 | 0 | 160 | 415.3 |
| A | 1 | 0 | 0 | 1 | 0 | 1 | 1 | 1 | 151 | 440 |
| A# | 1 | 0 | 0 | 0 | 1 | 1 | 1 | 0 | 142 | 468 |
| B | 1 | 0 | 0 | 0 | 0 | 1 | 1 | 0 | 134 | 496 |

Also indicated in Table 1 are the digital values of the binary words which are generated, and the resulting frequency produced by the universal tone generators. Since the third, fifth, and seventh interval notes are produced by channels having a single divide-by-two divider, the audible frequencies produced are the same when the same binary word is gated into the different interval channels. However, the root frequency is two thirds times the interval frequency indicated in Table 1, due to the different divider circuit in the root output channel. In all cases, the generated binary word has a digital value which is inversely proportional to the frequency of the desired tone. In prior tone generators, the binary word has represented the order of the note in an octave. For example, a digital value of three has represented a D note, namely, the third note from the lowest frequency C note. The digital values of the words in Table 1, to the contrary, correspond to a multiple of the actual frequency which is to be sounded. The available digital values, in order to closely simulate the twelve notes of an octave, must be greatly in excess of the values of the number of notes to be simulated. Preferably, at least eight bit positions are available to form the twelve notes to be sounded.

Figure 3:
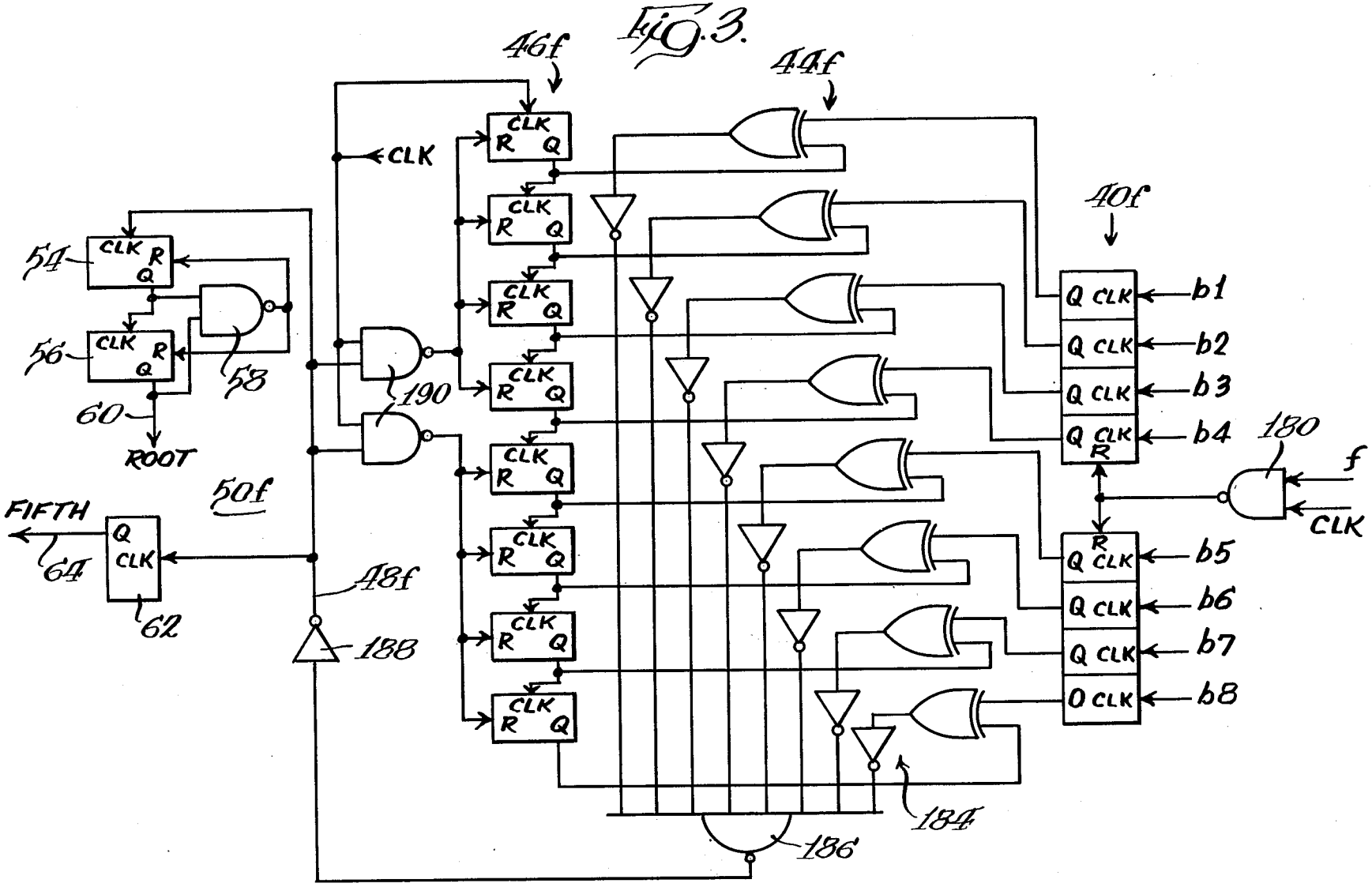
FIG. 3 is a schematic diagram showing in detail the root and fifth tone generator shown in block form in FIG. 1.

Turning to FIG. 3, the universal chord generator for the root and fifth notes is illustrated in detail. The binary word b1–b8 from the ROM 36 is coupled to the clock CLK inputs of eight flip-flops 40*f*. The flip-flops have a Q output which changes state on the transition at its input from a logic 1 bit to a logic 0 bit. The fifth line f from the multiplex circuit 30 is coupled to a NAND gate 180 along with the clock pulses CLK. Thus, the flip-flops 40*f* store the binary word present on the b input lines when the ROM memory has an output representing the fifth interval binary word.

The eight Q outputs of the flip-flops 40*f* are coupled individually to corresponding inputs of eight Exclusive OR gates 44*f*. Each Exclusive OR gate has a 0 bit output when its pair of input lines have the same (matching) bits thereon, that is, either two 0 bits or two 1 bits. The opposite inputs of the Exclusive OR gates are individually coupled to the Q outputs of eight flip-flops 46*f* connected as a binary counter which counts up from zero. The binary counter is clocked by the 66.44 KHz clock pulses CLK and counts in a binary fashion until the binary count stored therein matches the binary count stored in the flip-flops 40*f*. When all inputs match, all Exclusive OR gates 44*f* have 0 bit outputs, which are inverted by associated NOT gates 184 to generate all 1 inputs to a NAND gate 186. This produces a 0 bit output which is inverted by a NOT gate 188 to produce a 1 bit output (or reset) pulse on line 48*f*. The 1 bit output pulse is coupled to a pair of NAND gates 190 which, at the time of the next clock pulse CLK, resets all of the binary connected flip-flops 46*f*.

As soon as the binary counter is reset, it begins counting up until it again reaches a binary count corresponding to the binary word stored in the flip-flops 40*f*. For example, assuming that the ROM 36 generates the binary word 10101001 for the G note, the binary connected flip-flops 46*f* will count the digital value thereof, namely, 169 of the clock pulses CLK before matching the word in flip-flop 40*f*. Since the clock frequency is 66.44 KHz, a pulse appears on line 48*f* every 169/66,440 seconds, i.e., once every 2,543 microseconds. Since frequency is the reciprocal of the period, this equals a frequency of approximately 393.1 Hz. The root channel divides the output pulse train by three, resulting in a frequency of about 131.03 Hz, representing the G note. Since the fifth interval channel divides by two, it produces an output frequency of about 196.55 Hz, representing the fifth note. When a different binary word is stored in the memory latch 40*f*, new root and fifth tone signals will be generated. Thus, the FIG. 3 circuit in combination with the binary word generator forms a universal tone generator in that any note in an octave can be generated from the same circuit. Since the clock oscillator 31 has a fixed frequency the universal tone generator varies the number of pulses generated during a fixed time period.

The binary words selected to represent each note could, of course, be changed so that the output pulses on line 48*f* have the desired tonal frequency without further division. The advantage of using a divider is that it generates a symmetrical square wave from the asymmetrical pulse train. Similarly, a pair of universal tone generators could be provided for the root note channel and the fifth note channel, and additional binary words could be permanently written in memory 36 to simulate more closely the actual frequencies of the root and fifth tones. While for greatest accuracy the tone generators produce the twelve notes within a single octave, it will be appreciated that other octaves can be produced. Alternative types of comparison circuits could be provided, and a count-down or polynomial counter rather than a count-up counter could of course be provided. Other methods for generating a train of pulses during a preselected increment or interval of time, with the train of pulses being directly or inversely proportional to a binary word, could be utilized with appropriate changes in circuitry. Other modifications will be apparent in view of the above teachings.

Having described the invention, the embodiments of the invention in which an exclusive property or privilege is claimed are defined as follows:

1. In an electronic musical instrument having a plurality of tone selector switches, a universal tone generator for generating tone signals of different frequencies, comprising:

binary word generating means responsive to actuation of at least one of said switches for generating a binary word having a digital value proportional to the frequency of the tone signal to be generated and representing a number of pulses to be generated during a given increment of time; and pulse generating means responsive to the binary word generating means including a counter means and a comparator means repetitively generating an output pulse when the accumulated count in said counter means equals the digital value of the binary word from said binary word generating means.

2. The electronic musical instrument of claim 1 wherein the means for generating binary words includes a memory having a plurality of output lines equal to the number of bits which form the binary words, a plurality of input lines equal to the plurality of tone selector switches, each input line having associated therewith a plurality of coupling means for interconnecting the input line to different ones of the plurality of output lines to generate a binary word when a control signal is present on the input line, and selector means coupled between the plurality of tone selector switches and the plurality of input lines for generating the control signal on a particular input line when the switch corresponding thereto has been actuated.

3. The electronic musical instrument of claim 1 further including a multiplex circuit for causing at least two different binary words to be repetitively generated by the means for generating binary words, and the pulse generating means comprises at least two pulse generating circuits each generating a number of pulses proportional to the digital value of the binary word gated thereto, and gating means for coupling the binary word generating means repetitively to the pulse generating circuits under control of the multiplex circuit to cause each pulse generating circuit to generate a different cyclical tone signal.

4. The electronic musical instrument of claim 3 wherein each pulse generating circuit includes storage means for storing each binary word gated thereto under control of the multiplex circuit.

5. The electronic musical instrument of claim 1 including a chord selector means for each tone selector switch and responsive to actuation of the associated switch for actuating a plurality of control lines representing tones which form a selected chord, the means for generating binary words being responsive to actuation of the control lines to generate binary words, and the pulse generating means including plural channels each responsive to a binary word for generating a number of pulses proportional to the digital value of the associated binary word.

6. The electronic musical instrument of claim 5 wherein each chord selector means includes a plurality of gate actuable in sequence to actuate the plurality of control lines, each control line representing a tone for forming the chord, a multiplex circuit for sequentially actuating the plurality of gates, the means for generating the binary words having a common output at which the binary words occur in sequence, and each channel of the pulse generating means including a storage means controlled by the multiplex circuit for storing one of the binary words present at the common output.

7. A circuit for generating chords in an electronic musical instrument having a plurality of tone selector switches, comprising:

chord selector means for each tone selector switch for actuating a plurality of control lines representing tones which form the selected chord;

encoding means for producing encoded signals representing each of the tones which form the selected chord;

an oscillator for generating a series of clock pulses;

counter means coupled to the oscillator for counting the clock pulses; and comparator means for repetitively providing an output pulse each time the accumulated count of the counter means equals the value of the encoded signals, whereby the repetitive output pulses have a frequency proportional to the tones in the chord.

8. The circuit of claim 7 including reset means responsive to each output pulse for resetting the counter means to a predetermined count.

9. The circuit of claim 8 wherein the encoding means generates a binary word which corresponds to each of the encoded signals, and the comparator means generates the output pulse each time the count of the counter means equals the digital value of the binary word.

10. The circuit of claim 9 wherein the comparator means comprises a plurality of exclusive OR gates each having two inputs and an output, one of said inputs of the exclusive OR gates being coupled to the encoding means, and the other of said inputs being coupled to the counter means, and a gate responsive to identical outputs from all of the exclusive OR gates for generating the output pulse.

11. The circuit of claim 7 wherein the encoding means comprises a word generator responsive to actuation of individual tone selector switches for generating encoded words each having a unique digital value representing a number of clock pulses for a given increment of time, memory means for storing the encoded words, the comparator means being coupled to the counter means, and the memory means for comparing the encoded words with the count of the counter means.

12. The circuit of claim 11 wherein the memory means has a plurality of output lines each of which can carry a binary bit thereon, the plurality of output lines being capable of carrying a binary word having a digital value in excess of the number of encoded words available from the encoded word generator.

13. The circuit of claim 12 wherein the encoded word generator can generate twelve binary words representing twelve tones forming a single octave, and the number of output lines is at least equal to eight to form eight bit binary words having a digital value proportional to the frequency of the tone to be generated.

* * * * *